US006406800B1

(12) United States Patent
Ozaki et al.

(10) Patent No.: US 6,406,800 B1
(45) Date of Patent: Jun. 18, 2002

(54) BENT PIPE FOR PASSING THERETHROUGH A MATERIAL CONTAINING SOLIDS

(75) Inventors: Makoto Ozaki, Kyotanabe; Daisuke Minohara, Akashi, both of (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 09/521,665

(22) Filed: Mar. 8, 2000

(30) Foreign Application Priority Data

Feb. 2, 2000 (JP) ..... 2000-025237

(51) Int. Cl.[7] ..... B32B 15/18; B22D 19/16

(52) U.S. Cl. ..... 428/682; 138/143; 138/177; 148/519; 148/534; 164/461; 164/477; 164/91; 164/95; 164/114; 164/DIG. 3; 428/684; 428/908.8; 428/926

(58) Field of Search ..... 428/682, 684, 428/908.8, 926; 164/461, 477, 91, 95, 114, DIG. 3; 148/519, 521, 534; 228/196, 197; 138/143, 177

(56) References Cited

FOREIGN PATENT DOCUMENTS

JP 1-162554 A * 6/1989 ..... 164/95
JP 7-18331 A * 1/1995 ..... C21D/8/10

* cited by examiner

*Primary Examiner*—Deborah Jones
*Assistant Examiner*—Robert R. Koehler
(74) *Attorney, Agent, or Firm*—Armstrong, Westerman, Hattori, McLeland & Naughton, LLP

(57) ABSTRACT

A bent pipe for use in piping arrangement for transporting materials conaining solids, the bent pipe being prepared by subjecting to high-frequency bending work a straight blank pipe prepared by centrifugal casting and having a plurality of layers. The straight blank pipe comprises an outer layer made of a steel having high weldability, and an inner layer made of a high Cr cast iron containing at least Cr in an amount of 10 to 35 wt. % and having high wear resistance, the outer layer and the inner layer being metallurgically joined. Preferably, a barrier layer is provided between the outer layer and the inner layer for preventing an alloy component in each of the layers from diffusing into the other layer. The barrier layer is preferably about 10 to about 100 μm in thickness.

19 Claims, 2 Drawing Sheets

(1 of 2 Drawing Sheet(s) Filed in Color)

BENT PIPE FOR PASSING THERETHROUGH A MATERIAL CONTAINING SOLIDS

FIELD OF THE INVENTION

The present invention relates to bent pipes suitable for use in piping arrangement for transporting materials containing solids, and to a process for producing the bent pipes.

BACKGROUND OF THE INVENTION

Solid material transport systems having a pipe for passing therethrough a solid material such as oil sand, coal, ore, sand, earth or municipal refuse have the pipe inner surface thereof exposed to a severe abrasive environment and therefore need to have a sufficient wear resistance over the pipe inner surface. This need increases all the more especially in bent pipes. High Cr cast iron which is excellent in wear resistance has theretofore been used favorably as a material for such pipes.

However, since the high Cr cast iron is low in weldability, pipes of this material cannot be joined to one another by butt welding as required for providing piping systems.

Accordingly, as shown in FIG. 3, a pipe 10 of double-layer structure has been proposed and placed into use which comprises an inner layer 11 of high Cr cast iron and an outer layer 12 of carbon steel or the like which has high weldability. This double-layer pipe 10 is produced by centrifugal casting. After casting the outer layer 12, the inner layer 11 is cast, whereby the inner layer is metallurgically joined with the outer layer to provide a metallurgically integral structure of the two layers.

When such double-layer pipes 10 are used to provide a piping system, one pipe is joined directly to another by butt welding W1 at their outer layers 12, or a flange 13 is welded as at W2 to the outer layer 12 of each of pipes, and the flanges are attached to each other to form a joint for connecting the pipes.

In constructing piping systems, there arises a need to use bent pipes having bent portions of various shapes, such as elbows, U-shaped pipes and S-shaped pipes.

Bent portions can be formed in pipes typically by high-frequency bending work. However, no report has been made on bent pipes of high Cr cast iron formed by high-frequency bending work since high Cr cast iron is brittle and therefore susceptible to cracking when subjected to the bending work. For this reason, it has been thought that the double-layer pipe having an inner layer of high Cr cast iron cannot be worked by high-frequency bending.

To produce bent pipes of a high Cr cast iron to be used in pipe arrangement for transporting solid materials, therefore, a mold of a specified shape is prepared, a bent pipe member is produced by stationary casting, and a flange of carbon steel or like material having high weldability is attached to an end of the pipe member by insert casting. However, this method is not only inefficient and costly, but also has a problem with respect to the reliability of quality of the product in that the pipe produced by stationary casting is likely to have casting defects such as shrinkage cavities unlike centrifugally cast pipes.

We have accomplished the present invention based on the finding that the double- layer pipe described and produced by centrifugal casting can be subjected to high-frequency bending work under optimum conditions.

SUMMARY OF THE INVENTION

The present invention relates to a bent pipe for passing therethrough a material containing solids, the bent pipe being formed by subjecting to high-frequency bending work a straight blank pipe prepared by centrifugal casting and having a plurality of layers, the straight blank pipe comprising an outer layer made of a steel having high weldability, and an inner layer made of a high Cr cast iron containing at least Cr in an amount of 10 to 35 wt. % and having high wear resistance, the outer layer and the inner layer being metallurgically joined.

The present invention relates also to a process for producing a bent pipe for passing therethrough a material containing solids, the process comprising a step of preparing by centrifugal casting a straight blank pipe comprising an outer layer of a steel having high weldability and an inner layer of a high Cr cast iron having high wear resistance, the outer layer and the inner layer being metallurgically joined, and a step of forming the bent pipe by subjecting the straight blank pipe to high-frequency bending work, the high-frequency bending work being performed by raising the temperature of the straight pipe at a rate of 50–250° C./min and heating the straight blank pipe at a temperature of 1000 to 1050° C. by high-frequency heating, bending the straight blank pipe at a rate of 0.3–0.8 mm/sec in the same temperature range, and thereafter cooling the resultant bent pipe at a rate of up to a maximum of 50° C./min.

Preferably, the straight blank pipe prepared by centrifugal casting has a barrier layer formed between the outer layer and the inner layer for preventing an alloy component of each of the layers from diffusing into the other layer. It is desired that the barrier layer be about 10 to about 100 $\mu$m in thickness.

BRIEF DESCRIPTION OF THE DRAWINGS

The file of this patent contains at least one drawing executed in color. Copies of this patent with color drawing will be provided by the Patent and Trademark Office upon request and payment of the necessary fee.

DETAILED DESCRIPTION OF THE INVENTION

Figure 1:
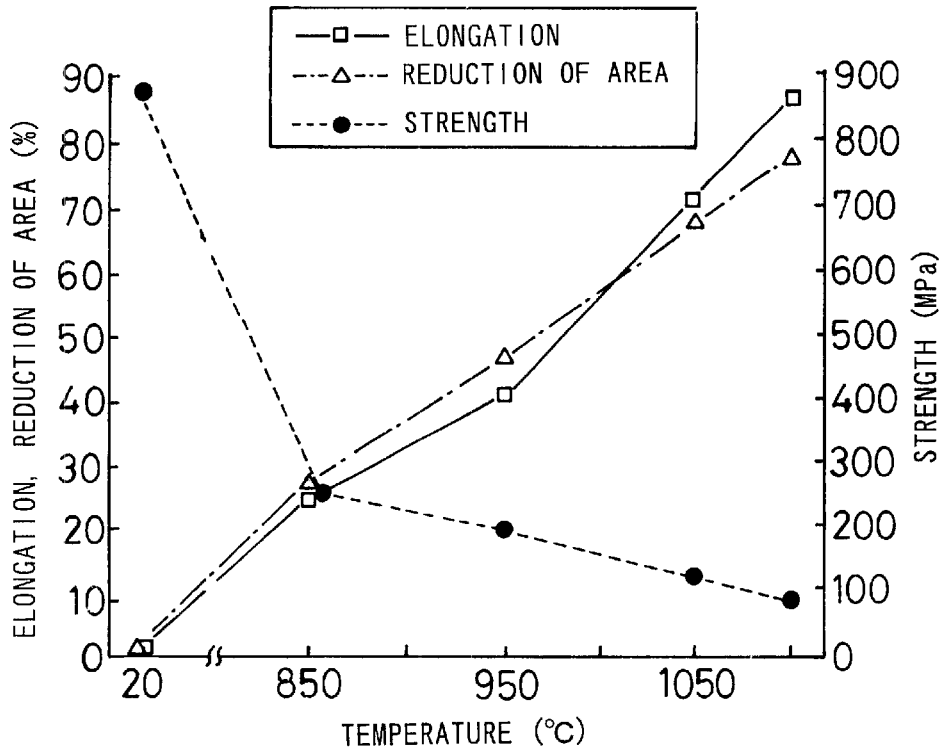
FIG. 1 is a graph showing the relationship between the mechanical properties of a 27 Cr type cast iron and the temperature.

A detailed description will be given below with regard to bent pipes for use in piping systems for transporting solid materials.

The bent pipe of the present invention is produced by subjecting a straight blank pipe having a plurality of layers to high-frequency bending work, the straight blank pipe being prepared by centrifugal casting which pipe comprises an outer layer of a steel having high weldability, and an inner layer of a high Cr cast iron having high wear resistance, the outer layer and the inner layer being metallurgically joined.

Material for Outer Layer

Preferable to use for the outer layer is a carbon steel or an alloy steel containing at least C in an amount in wt. % of over 0% to not greater than 0.25%.

Examples of such alloys are those having a chemical composition comprising, in wt. %, over 0% to not greater than 0.25% of C, up to 1.5% of Si, up to 1.5% of Mn and, when desired, a suitable amount of at least one element selected from among Ni, Mo, V, etc., the balance being substantially Fe. Suitable to use are, for example, JIS G5102, "Cast Steels for WeldStructures", SCW410, 450, etc.

Material for Inner Layer

Preferably to use for the inner layer is a high Cr cast iron containing at least Cr in an amount of 10 to 35 wt. % because the high Cr cast iron is most suitable for assuring the pipe inner surface of the desired wear resistance.

Examples of such high Cr cast irons typically has a composition comprising, in wt. %, 2.0 to 3.5% of C, up to 2.0% of Si, up to 2.0% of Mn, 10 to 35% of Cr and the balance substantially Fe.

Examples of preferred high Cr cast irons are 27 Cr type cast irons comprising, in wt. %, 2.0 to 3.5% of C, up to 2.0% of Si, up to 2.0% of Mn, 23 to 35% of Cr and the balance substantially Fe. These cast irons have a white iron structure comprising a precipitate of iron-chromium double carbide dispersed in a hard martensitic matrix.

When desired, at least one element selected from the group consisting of 0.3 to 1.5% of V, 1.0 to 4.0% of Mo, 0.5 to 2% of Cu and 1.5 to 3.0% of Ni can be present in the high Cr cast iron.

Preparation of Straight Blank Pipe by Centrifugal Casting.

The outer layer forming metal is placed in a molten state into a centrifugal casting mold, and the inner layer forming metal is placed as melted into the mold immediately before the complete solidification of the inner surface of an outer layer or immediately after the complete solidification of the outer layer to melt the outer layer inner surface again, whereby a straight blank pipe is prepared in which an outer layer is metallurgically joined with the inner layer.

The inner layer material and the outer layer material become mixed with each other at the metallurgically joined portion, with the material of each layer diffusing through the material of the other layer. If the Cr of the inner layer diffuses from the joined portion into the outer layer to reach a position close to the surface of the outer layer, the outer layer is liable to crack when subjected to high-frequency bending work. Accordingly, it is necessary to give the outer layer a thickness which is greater by an amount corresponding to the region of diffusion of Cr.

Table 1 shows examples of designs typical of the bent pipes, although the thickness of the region of diffusion differs with the outside diameter of the pipe, thickness of the inner layer, pouring timing of the inner layer molten metal, etc. The value in the parentheses in the outer layer column of Table 1 indicates the thickness of the region of diffusion.

TABLE 1

| Outside Diameter | Inner Layer | Outer Layer | (Diffusion Region) |
|---|---|---|---|
| 100–400 mm | 10–30 mm | 10–30 mm | (5–10 mm) |
| 400–700 mm | 15–60 mm | 15–35 mm | (10–15 mm) |
| 700–1000 mm | 20–100 mm | 25–45 mm | (15–20 mm) |

In order to prevent the alloy component of each of the layers from diffusing into the other layer, a barrier layer can be provided between the outer layer and the inner layer. In this case, the outer layer can be made thinner by an amount corresponding to the thickness of the region of diffusion.

The barrier layer can be formed by the following procedure.

In the centrifugal casting process, a small amount of the inner layer forming molten metal is placed into the mold approximately simultaneously with the complete solidification of the outer layer inner surface to melt the solidified portion of the outer layer again. The remelted portion provides the barrier layer for preventing the material of the inner layer from diffusing into the outer layer as will be described later.

Since the amount of molten metal placed in at this time is small, the remelted region is very small and starts to solidify immediately. The material of the inner layer is. therefore almost unlikely to diffuse into the outer layer beyond the remelted region. Stated more specifically, the amount of inner layer molten metal to be placed in is such that the remelted region at the outer layer inner surface will have a thickness of about 10 to about 100 $\mu$m. If the thickness is less than 10 $\mu$m, the barrier layer will not be fully joined with the outer layer metallurgically, whereas if the thickness is greater than 100 $\mu$m, it is likely that the material of the inner layer will start to diffuse into the outer layer. More preferably, the thickness is 20 to 50 $\mu$m.

The molten metal for forming an inner layer is subsequently placed in, whereby the remelted region as solidified is melted again, and the resulting remelted region provides a barrier layer for preventing the inner layer material from diffusing into the outer layer. The inner layer is metallurgically joined with the barrier layer.

Since the outer layer material and the inner layer material become mixed with each other in the barrier layer, the barrier layer has a composition approximately intermediate between those of the outer and inner layers.

Conditions for High-Frequency Bending Work

To subject the centrifugally cast straight pipe to high-frequency bending work without permitting the high Cr cast iron material of the inner layer to develop cracks, it is important to properly determine (i) the bending work temperature, (ii) the rate of increase in temperature to the work temperature, (iii) the rate of bending in the work temperature range, and (iv) the rate of decrease in temperature for cooling subsequent to the work.

(i) Bending Work Temperature

It is important that the straight blank pipe be bent in a temperature range wherein the elongation and reduction of area of the inner layer are each at least 50%.

FIG. 1 shows the relationship between the mechanical properties (elongation, reduction of area and strength) and the temperature, as established for a specimen material having a composition typical of the aforementioned 27 Cr cast irons (2.3% of C, 1.0% of Si, 1.2% of Mn, 28% of Cr, 1.5% of Mo and the balance substantially Fe).

FIG. 1 reveals that the elongation and reduction area are over 50% at temperatures of at least 1000° C. The bending work temperature therefore needs to be at least 1000° C.

The higher the temperature, the greater the elongation and reduction of area are, but the outer layer becomes coarser in structure, exhibiting pronounced surface spalling with this tendency. The pipe is also liable to deform to an elliptical shape undesirably owing to buckling. It is accordingly desired to perform the bending work at a temperature of up to 1050° C.

(ii) Rate of Increase in Temperature

The temperature is raised to the work temperature at an adjusted moderate rate of 50–250° C./min.

The reason is that if the rate is higher than 250° C./min, the high Cr cast iron material of the inner layer is prone to crack during the rise of temperature, whereas rates lower than 50° C./min entail no benefit and are unfavorable with respect to the bending work efficiency.

The rate of increase in temperature is preferably 75–125° C./min.

(iii) Rate of Bending

The rate of bending is adjusted to the range of 0.3–0.8 mm/sec.

If the rate is greater than 0.8 mm/sec, the inner layer is susceptible to cracking, whereas rates smaller than 0.3 mm/sec result in no benefit and are unfavorable from the viewpoint of bending efficiency.

(iv) Rate of Decrease in Temperature

The rate of decrease in temperature for the cooling step subsequent to the work is adjusted to not higher than 50° C./min.

If the rate is over 50° C./min, cracking is liable to occur during the cooling step. The rate is preferably up to 45° C./min. Since the temperature can be lowered at a rate of at least about 20° C./min even by spontaneous cooling in the air, there is no benefit to adjust the decrease in temperature to a rate lower than this value.

High-Frequency Bending Work

Figure 2:
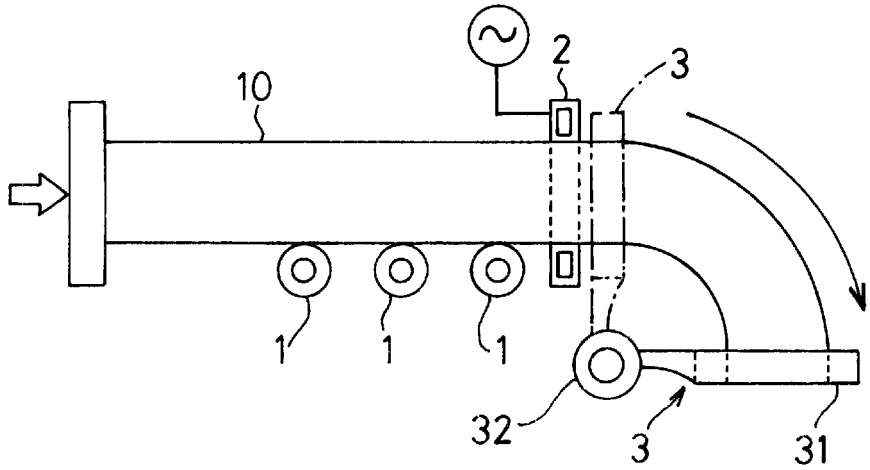
FIG. 2 is a diagram schematically showing high-frequency bending work.
Figure 3:
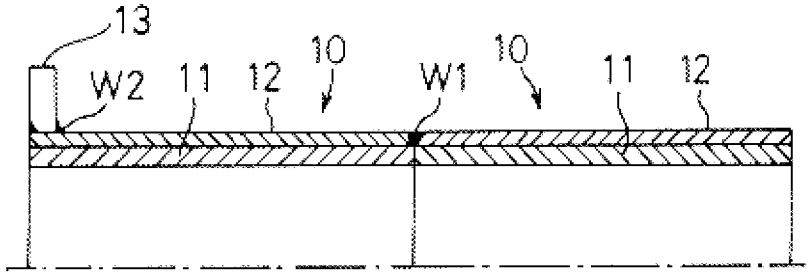
FIG.3 PRIOR ART
FIG. 3 is a diagram for illustrating centrifugally cast pipes of double-layer structure as joined to each other.

The high-frequency bending work is performed by the procedure to be described below with reference to FIG. 2.

The drawing shows a high-frequency bending apparatus, which comprises guide rollers 1 providing a path of transport of a pipe member 10, a high-frequency induction heating coil 2 disposed on the transport path, and a clamp arm 3 for controlling the direction of transport of the pipe member 10. The clamp arm 3 has a chuck 31 for holding the forward end of the pipe member 10 and a base end movably supported by a pivot 32.

The pipe member 10 as held by the clamp arm 3 at its forward end is pushed forward at a predetermined speed of transport by a pressure applied to the rear end thereof while being heated by the high-frequency coil 2. The clamp arm 3 is pivotally moved with the transport of the pipe member 10, whereby the pipe member 10 is bent to a curved form.

The bending work temperature, the rate of increase in temperature and the rate of bending of the pipe member to be bent is adjusted according to the power source output for the high-frequency coil 2 and the feed speed of the pipe member 10. The rate of bending is equal to the feed speed of the pipe member.

The radius of curvature of the bent pipe to be obtained can be determined as desired by varying the arm length of the clamp arm 3. Pipes bent to a desired shape and having a desired bending angle, such as S-shaped pipes, 90-degree elbows and U-shaped pipes, can be formed by varying the angle through which the clamp arm 3 is pivotally moved.

According to the present invention, bent pipes having a radius of curvature (of the center line thereof) which is as small as two times the outside diameter of the pipe can be produced by using a straight blank pipe prepared by centrifugal casting and having a plurarity of layers.

The pipe member subjected to the high-frequency bending work is thereafter cooled in the air (allowed to cool in the atmosphere), whereby the inner layer is given the specified hardness required of bent pipes for use in transporting solid materials. When a higher hardness is to be obtained, the pipe thus prepared is held heated at a temperature of 1000 to 1050° C. for at least 3 hours and thereafter allowed to cool in the atmosphere. This heat treatment affords a harness Hv of at least about 700.

EXAMPLE

Specimen pipes were prepared by centrifugal casting. The compositions of the specimen pipes (a), (b), (c) and (d), (e), (f) are shown in Tables 2 and 3. The dimensions of the specimen pipes obtained are shown in Table 4. Specimen pipes (c) and (f) had a barrier layer between the outer layer and the inner layer.

TABLE 2

| Specimen Pipe | Composition (in wt. %) balance substantially Fe | | | | | |
|---|---|---|---|---|---|---|
| (a) (b) (c) | C | Si | Mn | Cr | Mo | V |
| Inner Layer | 2.18 | 0.8 | 1.0 | 27.5 | 0.28 | 0.15 |
| Outer Layer | 0.16 | 0.3 | 0.9 | — | — | — |

TABLE 3

| Specimen Pipe | Composition (in wt. %) balance substantially Fe | | | | |
|---|---|---|---|---|---|
| (d) (e) (f) | C | Si | Mn | Cr | Mo |
| Inner Layer | 2.28 | 0.5 | 1.0 | 27.9 | 0.4 |
| Outer Layer | 0.22 | 0.5 | 0.8 | — | — |

TABLE 4

| Specimen Pipe | Outside Diameter | Inner Layer | Barrier Layer | Outer Layer |
|---|---|---|---|---|
| (a) | 237 mm | 20.5 mm | — | 15.5 mm |
| (b) | 237 mm | 20.5 mm | — | 10 mm |
| (c) | 237 mm | 20.5 mm | 45 μm | 10 mm |
| (d) | 508 mm | 15.5 mm | — | 15.5 mm |
| (e) | 508 mm | 15.5 mm | — | 10 mm |
| (f) | 508 mm | 15.5 mm | 35 μm | 10 mm |

The specimen pipes were made into elbows (90-degree bent pipes) using the high-frequency bending apparatus described. The designed radius of curvature of each elbow (i.e., of the center line thereof) was 2.8×D (mm) wherein D (mm) is the outside diameter of the specimen pipe. More specifically, the specimen pipes (a) to (c) were about 664 mm, and the specimen pipes (d) to (f) were about 1422 mm, in radius of curvature.

Table 5 shows the conditions for the bending work (rate of increase in temperature, work temperature, rate of bending and rate of decrease in temperature) and the work results.

TABLE 5

| | | Working Conditions | | | | |
|---|---|---|---|---|---|---|
| No. | Specimen Pipe | Rate of temp. increase (° C./min) | Work temp. (° C.) | Bending Rate (mm/sec) | Rate of temp. decrease (° C./min) | Results |
| 1 | (a) | 135 | 1000 | 0.4 | 30 | Good (no crack or surface spalling) |
| 2 | (a) | 155 | 1025 | 0.4 | 30 | Good (no crack or surface spalling) |
| 3 | (a) | 200 | 1050 | 0.4 | 35 | Good (no crack or surface spalling) |
| 4 | (a) | 260 | — | — | — | Inner layer cracked during temp. rise |
| 5 | (a) | 150 | 950 | 0.4 | — | Inner layer cracked during bending |

TABLE 5-continued

| No. | Specimen Pipe | Working Conditions: Rate of temp. increase (° C./min) | Work temp. (° C.) | Bending Rate (mm/sec) | Rate of temp. decrease (° C./min) | Results |
|---|---|---|---|---|---|---|
| 6 | (a) | 130 | 1100 | 0.4 | 35 | Outer layer surface markedly spalled |
| 7 | (a) | 130 | 1025 | 0.4 | 60 | Inner layer cracked during temp. drop |
| 8 | (b) | 135 | 1000 | 0.4 | — | Outer layer cracked during bending |
| 9 | (c) | 135 | 1000 | 0.4 | 30 | Good (no crack or surface spalling) |
| 10 | (c) | 200 | 1050 | 0.4 | 35 | Good (no crack or surface spalling) |
| 11 | (d) | 140 | 1000 | 0.4 | 30 | Good (no crack or surface spalling) |
| 12 | (d) | 170 | 1025 | 0.4 | 30 | Good (no crack or surface spalling) |
| 13 | (d) | 200 | 1050 | 0.4 | 35 | Good (no crack or surface spalling) |
| 14 | (d) | 260 | — | — | — | Inner layer cracked during temp. rise |
| 15 | (d) | 155 | 950 | 0.4 | — | Inner layer cracked during bending |
| 16 | (d) | 130 | 1025 | 0.4 | 60 | Inner layer cracked during temp. drop |
| 17 | (e) | 140 | 1000 | 0.4 | — | Outer layer cracked during bending |
| 18 | (f) | 140 | 1000 | 0.4 | 30 | Good (no crack or surface spalling) |
| 19 | (f) | 200 | 1050 | 0.4 | 35 | Good (no crack or surface spalling) |

With reference to Table 5, No. 1 to No. 3, No. 9 and 10, No. 11 to No. 13, No. 18 and No. 19 are examples of the invention, and were bent under the conditions within the ranges described in the foregoing paragraphs (i) to (iv). These examples were free of cracking and surface spalling, hence satisfactory results.

No. 8 and No. 17, although bent under the same conditions as No.1 and No. 11, developed cracks in the outer layer during bending work. This is thought attributable to the smaller wall thickness of the outer layer, permitting the Cr in the inner layer to diffuse into the outer layer to a position close to the surface thereof during centrifugal casting and giving lowered bendability to the outer layer.

On the other hand, No. 9 and No. 18 were satisfactory in result although the same as No. 8 and No. 17 in the thickness of the outer layer and bending conditions because the barrier layer formed between the outer layer and the inner layer prevented the diffusion of the inner layer component into the outer layer. No. 1 and No. 11 were also satisfactory in result although the same as No. 8 and No. 17 in bending conditions because the Cr in the inner layer failed to reach a position close to the surface of the outer layer owing to the increased wall thickness thereof, producing only a negligible influence.

No. 4 and No. 14 developed cracks in the inner layer during the rise in temperature to the work temperature since the temperature was raised at an excessively high rate.

No. 5 and No. 15 developed cracks in the inner layer during the bending work because of too low a bending work temperature.

The outer layer of No. 6 exhibited marked surface spalling due too high a bending work temperature.

No. 7 and No. 16 developed cracks in the inner layer during the decrease in temperature because the temperature was lowered at an excessively high rate after the bending work.

No. 1, No. 3, No. 9 and No. 10 were checked for the hardness of the inner layer after the bending work and also after a heat treatment subsequently conducted. Table 6 shows the measurements. For the heat treatment, the pipes were heated at 1050° C. for 5 hours and thereafter allowed to cool in the atmosphere.

TABLE 6

| No. | Hardness (Hv): After bending (Before heat treatment) | After heat treatment |
|---|---|---|
| 1 | 455 | 750 |
| 3 | 470 | 770 |
| 9 | 448 | 760 |
| 10 | 465 | 780 |

Table 6 reveals that each of the pipes according to the invention has its inner layer further increased in hardness by the heat treatment subsequent to the bending work.

Figure 4:
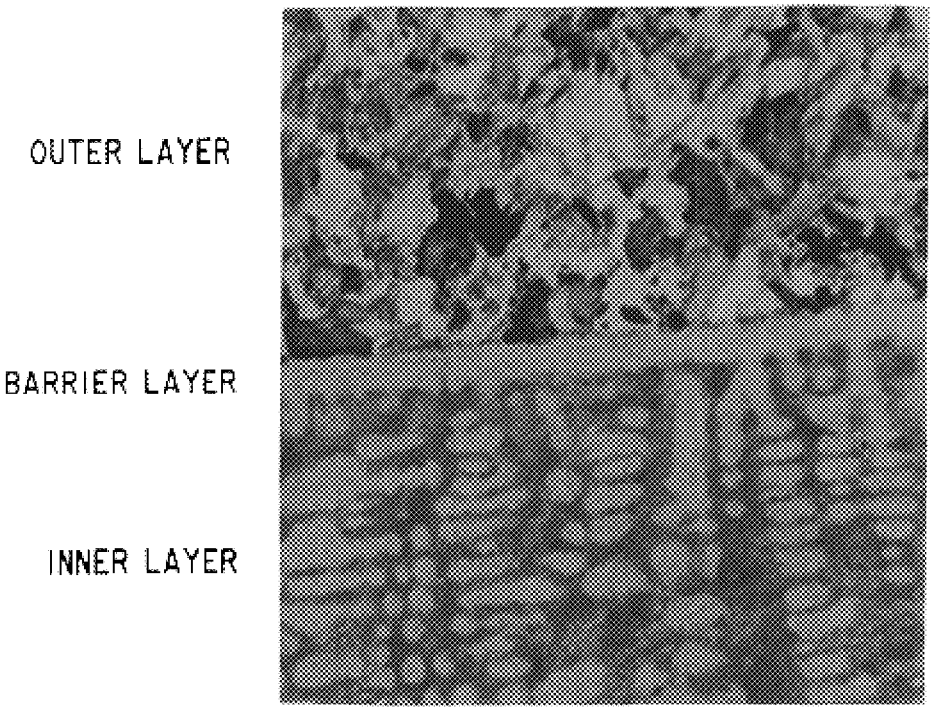
FIG. 4 is a photograph showing the metal structure (×100) of pipe No. 9 in the vicinity of a barrier layer thereof.

FIG. 4 shows the metal structure (×100) of pipe No. 9 in the vicinity of its barrier layer after the bending work.

According to the invention, bent pipes can be produced efficiently from a straight blank pipe having an inner layer of high Cr cast iron and prepared by centrifugal casting, by subjecting the blank pipe to high-frequency bending work. Since the blank pipe is a centrifugally cast pipe, the bent pipe of the invention is less susceptible to casting defects and has a higher quality than the conventional bent pipe which is produced by stationary casting.

The barrier layer provided between the outer layer and the inner layer for preventing the alloy component of each of the outer and inner layers from diffusing into the other layer makes it possible to render the outer layer thinner by an amount corresponding to the thickness of the region of diffusion that would otherwise be formed to reduce the material cost of the pipe.

The bent pipe of the invention is suitable for use as a piping member of which high wear resistance is required, for example, for transporting through the pipe channel a solid material such as oil sand, coal,ore, sand, earth or municipal refuse.

We claim:

1. A bent pipe for passing therethrough a material containing solids, the bent pipe being formed by subjecting to high-frequency bending work a straight blank pipe prepared by centrifugal casting and having a plurality of layers, the straight blank pipe comprising an outer layer made of a steel having high weldability, and an inner layer made of a high Cr cast iron containing at least Cr in an amount of 10 to 35 wt. % and having high wear resistance, the outer layer and the inner layer being metallurgically joined.

2. The bent pipe according to claim 1 wherein the high Cr cast iron of the inner layer consists essentially of, in wt. %, 2.0 to 3.5% of C, up to 2.0% of Si, up to 2.0% of Mn, 10 to 35% of Cr and the balance substantially Fe.

3. The bent pipe according to claim 2 wherein the high Cr cast iron of the inner layer further contains, in wt. %, at least one element selected from the group consisting of 0.3 to 1.5% of V, 1.0 to 4.0% of Mo, 0.5 to 2% of Cu and 1.5 to 3.0% of Ni.

4. The bent pipe according to claim 1 wherein the high Cr cast iron of the inner layer consists essentially of, in wt. %, 2.0 to 3.5% of C, up to 2.0% of Si, up to 2.0% of Mn, 23 to 35% of Cr and the balance substantially Fe.

5. The bent pipe according to claim 4 wherein the high Cr cast iron of the inner layer further contains, in wt. %, at least one element selected from the group consisting of 0.3 to 1.5% of V, 1.0 to 4.0% of Mo, 0.5 to 2% of Cu and 1.5 to 3.0% of Ni.

6. The bent pipe according to claim 1 wherein the steel of the outer layer is a carbon steel or an alloy steel containing at least C in an amount in wt. % of over 0% to not greater than 0.25%.

7. The bent pipe according to claim 1 wherein the inner layer is heat-treated after the bending work and has a hardness Hv of at least 700.

8. The bent pipe according to claim 2 wherein the solids are oil sand, coal, ore, sand, earth or municipal refuse.

9. A bent pipe for passing therethrough a material containing solids, the bent pipe being formed by subjecting to high-frequency bending work a straight blank pipe prepared by centrifugal casting and having a plurality of layers, the straight blank pipe comprising an outer layer made of a steel having high weldability, an inner layer made of a high Cr cast iron containing at least Cr in an amount of 10 to 35 wt. % and having high wear resistance, and a barrier layer formed between the outer layer and the inner layer for preventing an alloy component of each of the inner layer and the outer layer from diffusing into the other layer, the outer layer, the barrier layer and the inner layer being metallurgically joined.

10. The bent pipe according to claim 9 wherein the barrier layer is 10 to 100 $\mu$m in thickness.

11. The bent pipe according to claim 10 wherein the barrier layer is 20 to 50 $\mu$m in thickness.

12. The bent pipe according to claim 9 wherein the high Cr cast iron of the inner layer consists essentially of, in wt. %, 2.0 to 3.5% of C, up to 2.0% of Si, up to 2.0% of Mn, 10 to 35% of Cr and the balance substantially Fe.

13. The bent pipe according to claim 12 wherein the high Cr cast iron of the inner layer further contains, in wt. %, at least one element selected from the group consisting of 0.3 to 1.5% of V, 1.0 to 4.0% of Mo, 0.5 to 2% of Cu and 1.5 to 3.0% of Ni.

14. The bent pipe according to claim 9 wherein the high Cr cast iron of the inner layer consists essentially of, in wt. %, 2.0 to 3.5% of C, up to 2.0% of Si, up to 2.0% of Mn, 23 to 35% of Cr and the balance substantially Fe.

15. The bent pipe according to claim 14 wherein the high Cr cast iron of the inner layer further contains, in wt. %, at least one element selected from the group consisting of 0.3 to 1.5% of V, 1.0 to 4.0% of Mo, 0.5 to 2% of Cu and 1.5 to 3.0% of Ni.

16. The bent pipe according to claim 9 wherein the steel of the outer layer is a carbon steel or an alloy steel containing at least C in an amount in wt. % of over 0% to not greater than 0.25%.

17. The bent pipe according to claim 9 wherein the inner layer is heat-treated after the bending work and has a hardness Hv of at least 700.

18. A process for producing the bent pipe according to claim 1, the process comprising:

a step of preparing by centrifugal casting a straight blank pipe comprising an outer layer of a steel having high weldability and an inner layer of a high Cr cast iron having high wear resistance, the outer layer and the inner layer being metallurgically joined; and a step of forming the bent pipe by subjecting the straight blank pipe to high-frequency bending work;

the high-frequency bending work being performed by raising the temperature of the straight pipe at a rate of 50–250° C./min and heating the straight blank pipe at a temperature of 1000 to 1050° C. by high-frequency heating, bending the straight blank pipe at a rate of 0.3–0.8 mm/sec in the same temperature range, and thereafter cooling the resultant bent pipe at a rate of up to a maximum of 50° C./min.

19. A process for producing the bent pipe according to claim 9, the process comprising:

a step of preparing by centrifugal casting a straight blank pipe comprising an outer layer of a steel having high weldability, an inner layer of a high Cr cast iron having high wear resistance, and a barrier layer formed between the outer layer and the inner layer and metallurgically joined with the layers for preventing an alloy component of each of the layers from diffusing into the other layer;

the centrifugal casting being performed by casting an inner layer molten metal immediately after complete solidification of the outer layer to form the barrier layer and casting the inner layer molten metal immediately after complete solidification of the barrier layer to form the inner layer; and a step of forming the bent pipe by subjecting the straight blank pipe to high-frequency bending work;

the high-frequency bending work being performed by raising the temperature of the straight blank pipe at a rate of 50–25° C./min and heating the straight blank pipe at a temperature of 1000 to 1050° C. by high-frequency heating, bending the straight blank pipe at a rate of 0.3–0.8 mm/sec in the same temperature range, and thereafter cooling the resultant bent pipe at a rate of up to a maximum of 5° C./min.

* * * * *